US009002026B2

(12) United States Patent
Lin

(10) Patent No.: US 9,002,026 B2
(45) Date of Patent: Apr. 7, 2015

(54) HEADPHONE WITH SPEAKER FUNCTION

(75) Inventor: Chia-Chung Lin, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 783 days.

(21) Appl. No.: 13/278,665

(22) Filed: Oct. 21, 2011

(65) Prior Publication Data

US 2013/0101131 A1 Apr. 25, 2013

(51) Int. Cl.
*H04R 1/10* (2006.01)

(52) U.S. Cl.
CPC ..... *H04R 1/1008* (2013.01); *H04R 2420/03* (2013.01); *H04R 2430/01* (2013.01)

(58) Field of Classification Search
CPC ..... H04R 2420/03; H04R 2420/05; H04R 1/1041; H04R 1/1066; H04R 5/04; H04R 5/033; H04R 5/0335
USPC ..... 381/74, 120, 123, 370, 371, 374, 384
See application file for complete search history.

(56) References Cited

U.S. PATENT DOCUMENTS

| | | | | |
|---|---|---|---|---|
| 2008/0166002 | A1* | 7/2008 | Amsel | 381/370 |
| 2009/0041267 | A1* | 2/2009 | Lee et al. | 381/104 |
| 2011/0158435 | A1* | 6/2011 | Ono et al. | 381/120 |
| 2012/0093325 | A1* | 4/2012 | Tang | 381/28 |

* cited by examiner

*Primary Examiner* — Joseph Saunders, Jr.
(74) *Attorney, Agent, or Firm* — Muncy, Geissler, Olds & Lowe, P.C.

(57) ABSTRACT

A headphone with speaker function comprises a first playback unit, a second playback unit, a first audio source interface and a second audio source interface. Both the first playback unit and the second playback units have a speaker respectively. The first audio source interface is disposed on the first playback unit and is electrically connected to the two speakers simultaneously, while the second audio source interface can be disposed on the first playback unit or the second playback unit, and is electrically connected to the two speakers simultaneously via an amplifier circuit. From an external audio interface, an audio signal is transmitted to the headphone via the first audio source interface; at this moment, the headphone set is operated under a headphone mode. From an external audio interface, an audio signal is transmitted via the second audio source interface; at this moment, the headphone is operated under a speaker mode.

7 Claims, 3 Drawing Sheets

HEADPHONE WITH SPEAKER FUNCTION

BACKGROUND OF THE INVENTION

1. Field of Invention

The present invention relates to a headphone and more particularly to a headphone which can be operated under a headphone mode or a speaker mode when an audio signal is transmitted via different audio source interfaces.

2. Related Art

In the wake of the development trend of digitalization of music files, more electronic products which can play music files are introduced into the market. Electronic products with integrated multi-media functions are widely demanded nowadays, besides computers which can provide music playback function, mobile phones with integrated music playback function have been introduced long ago; so that users not only can communicate to others through mobile phones, but can enjoy the fun of listening to music outdoors via mobile phones with music play back function.

Be able to enjoy listening to music without affecting others, users have to do it by using earphones or headphones together with mobile phones or other music devices such as computers or walkmans, etc., so that users can listen to music or conversation by the earphones. If voice or music has to be shared with others around you, or if users feel uncomfortable after using the headphones for a long time, the headphones have to be unplugged or taken off from the ears, so that the voice or music can be played directly by the music devices as the output sources; but it is impossible for music devices without speakers, or for mobile phones with speakers of low output power, which is difficult for others to listen clearly. Therefore, it is a problem needs to be tackled and the functions of earphones or headphones need to be enhanced.

SUMMARY OF THE INVENTION

In view of the abovementioned problems, the present invention provides a headphone which can be operated under a headphone mode or a speaker mode, users can select the operating modes in order to enjoy the voice or music themselves, or have the voice or music shared with others.

In order to achieve the abovementioned objects, the present invention discloses a headphone with speaker function. It comprises a first playback unit, a second playback unit, a first audio source interface and a second audio source interface. The first playback unit has a first speaker, while the second playback unit has a second speaker. The first audio source interface is disposed on the first playback unit and is electrically connected to the first and the second speakers simultaneously, while the second audio source interface can be disposed on the first playback unit or the second playback unit, and is electrically connected to the first and the second speakers simultaneously via an amplifier circuit. From an external audio interface, an audio signal is transmitted to the headphone via the first audio source interface; at this moment, the headphone is operated under a headphone mode and the audio signal is playback directly via the first and the second speakers. From an external audio interface, an audio signal is transmitted via the second audio source interface; at this moment, the headphone is operated under a speaker mode and the audio signal is output via the first and the second speakers with louder volume after it is amplified by the amplifier circuit.

By providing the two audio source interfaces disposed on the playback units, the present invention allows users to connect an external audio interface to one of the audio source interfaces according to the requirements, so that the headphone can be operated under the headphone mode or the speaker mode with louder volume output, in order to play with a suitable volume to meet the circumstances.

DETAILED DESCRIPTION OF THE INVENTION

An embodiment of a headphone with speaker function of the present invention will become more fully understood by reference to the following detailed description thereof when read in conjunction with the attached drawings.

Figure 1:
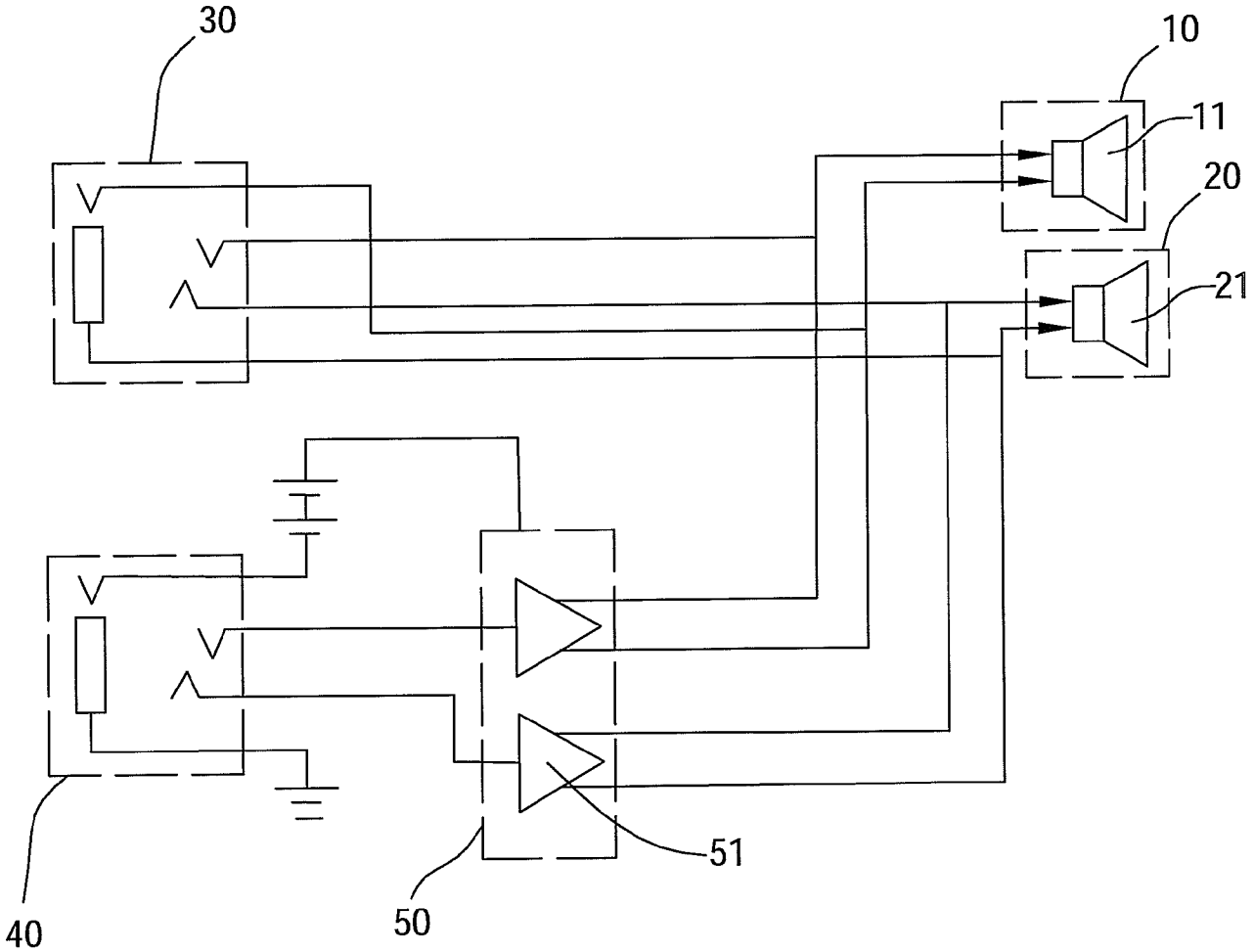
FIG. 1 is a schematic view of a circuit of a headphone with speaker function of the present invention.

Referring to FIG. 1, it shows a schematic view of a circuit of a headphone with speaker function of the present invention. A headphone with speaker function of the present invention comprises a first playback unit 10, a second playback unit 20, a first audio source interface 30 and a second audio source interface 40. The first playback unit 10 has a first speaker 11 for outputting sound, while the second playback unit 20 has a second speaker 21 for outputting sound. The first audio source interface 30 is disposed on the first playback unit 10 and is electrically connected to the first speaker 11 and the second speaker 21 simultaneously. In this embodiment, the second audio source interface 40 is disposed on the first playback unit 10 and is electrically connected to the first speaker 11 and the second speaker 21 simultaneously via an amplifier circuit 50. From an external audio interface, an audio signal is transmitted via the first audio source interface 30; at this moment, the headphone is operated under a headphone mode and the audio signal is playback via the first speaker 11 and the second speaker 21. From an external audio interface, an audio signal is transmitted via the second audio source interface 40; at this moment, the headphone is operated under a speaker mode and the audio signal is output via the first speaker 11 and the second speaker 21 with louder volume after it is amplified by the amplifier circuit 50.

In this embodiment, the amplifier circuit 50 includes two differential amplifiers 51 which are electrically connected to first speaker 11 and the second speaker 21 respectively. When an audio signal is transmitted via the second audio source interface 40, it is amplified by the two differential amplifiers 51; so that a sound output by the first speaker 11 and the second speaker 21 is louder than operating under the headphone mode without the amplifier circuit 50 in the circuit path. Therefore, the first speaker 11 and the second speaker 21 can output sound volumes as loud as a loudspeaker; so that people nearby can hear the sound clearly no matter if the audio signal is of voice or music.

Furthermore, both the first audio source interface 30 and the second audio source interface 40 have a three poles socket, therefore a corresponding external audio interface has to be a three poles plug. If both the first audio source interface 30 and the second audio source interface 40 are designed to have a four poles socket, then a corresponding external audio interface has to be a four poles plug. Specification for the sockets and plugs can be 3.5 mm which is commonly available.

Figure 2B:
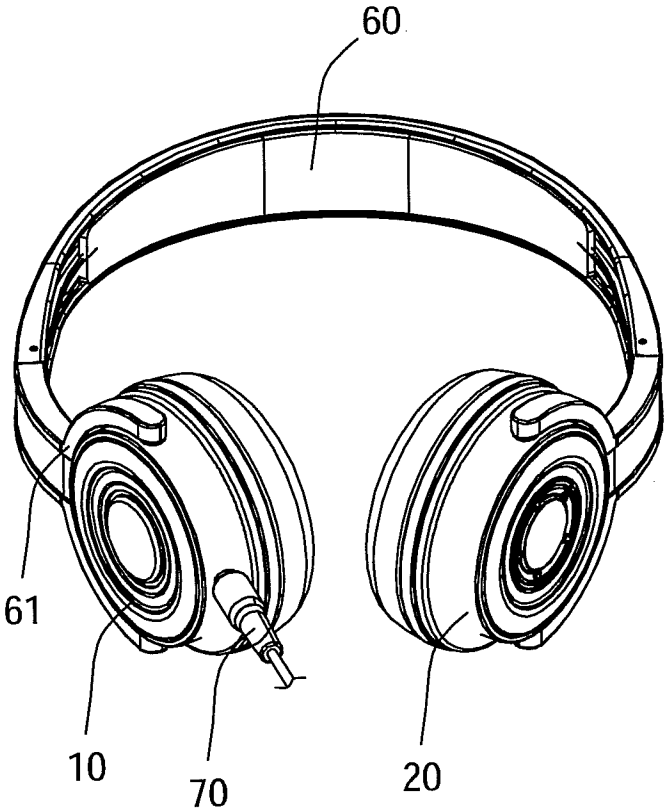
FIG. 2B is schematic view of a headphone with speaker function of the present invention after it is connected under a headphone mode.
Figure 2A:
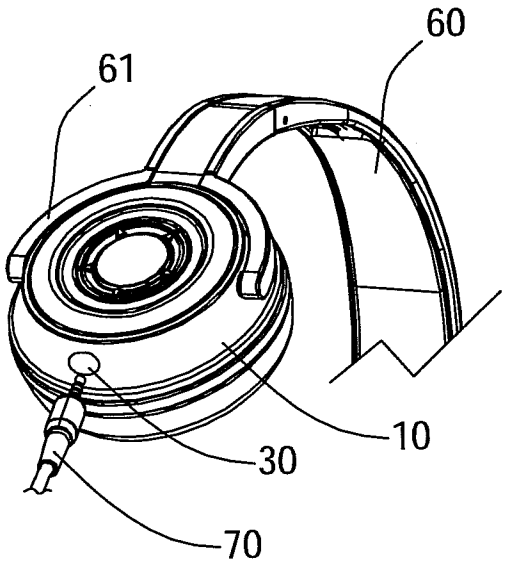
FIG. 2A is partial schematic view of a headphone with speaker function of the present invention before it is connected under a headphone mode.
Figure 3B:
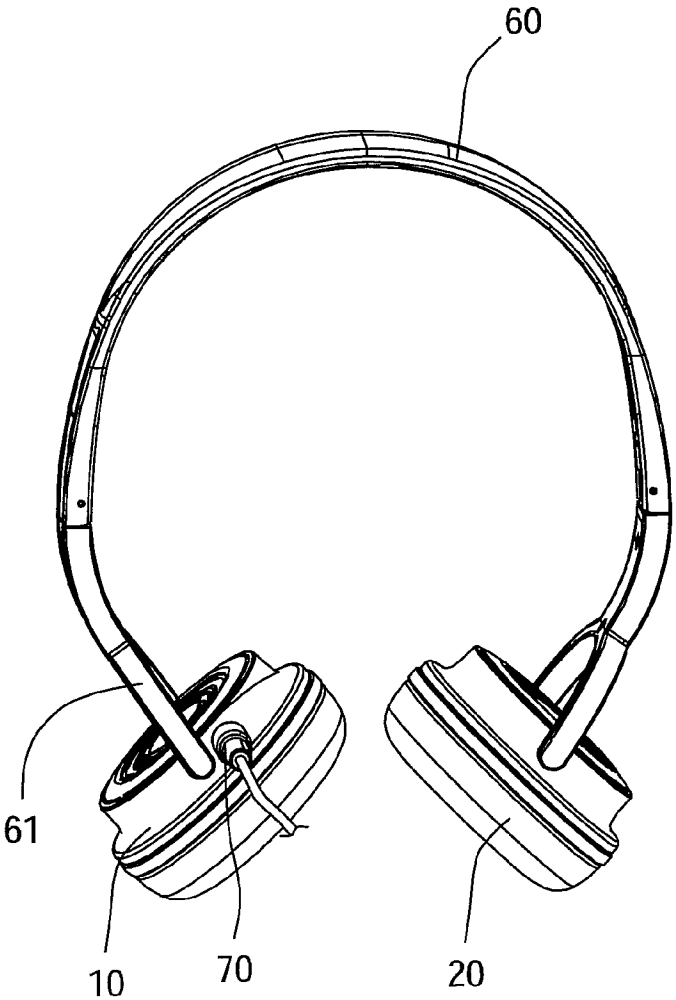
FIG. 3B is schematic view of a headphone with speaker function of the present invention after it is connected under a speaker mode.
Figure 3A:
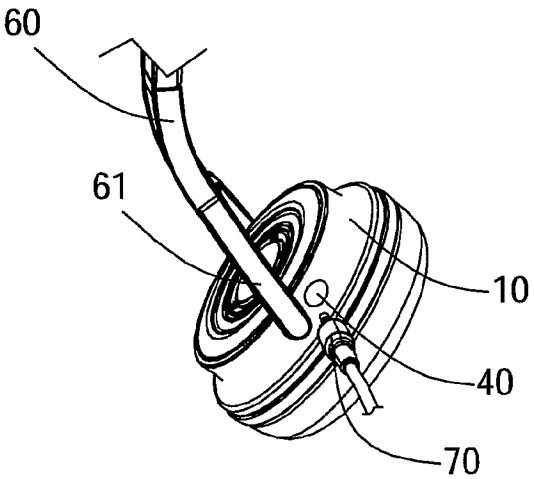
FIG. 3A is partial schematic view of a headphone with speaker function of the present invention before it is connected under a speaker mode.

Please refer to FIGS. 2A, 2B, 3A and 3B; FIG. 2A is partial schematic view of a headphone with speaker function of the present invention before it is connected under a headphone mode; FIG. 2B is schematic view of a headphone with speaker function of the present invention after it is connected under a headphone mode; FIG. 3A is partial schematic view of a headphone with speaker function of the present invention before it is connected under a speaker mode; FIG. 3B is schematic view of a headphone with speaker function of the present invention after it is connected under a speaker mode.

Referring to FIG. 2B, the first playback unit 10 and the second playback unit 20 of a headphone with speaker function of the present invention are connected to each other by a head band 60. A fork portion 61 is disposed at each end of the head band 60 for clamping the first playback unit 10 and the second playback unit 20 respectively. As shown in FIGS. 2A and 2B, when the headphone is placed on a user's head and is operating under the headphone mode, sound output surfaces of the first playback unit 10 and the second playback unit 20 are faced to an inner circumference of the head band 60, so that they can fit properly on the user's ears; at this moment, the first audio source interface 30 is pointing downward; the headphone mode is activated when an external audio interface 70 is inserted into the first audio source interface 30. Referring to FIG. 1, an audio signal is transmitted to the first speaker 11 and the second speaker 21 from the first audio source interface 30 via two circuit paths, and the sound is output to the user's left and right ears.

Furthermore, referring to FIGS. 3A and 3B, the user can turn the first playback unit 10 to make the sound output surface to face outward after the headphone is taken off from the head for switching to the speaker mode; so that the second audio source interface 40 hidden behind the fork portion 61 is exposed, and the external audio interface 70 can be inserted into the second audio source interface 40 in order to activate the speaker mode. Referring to FIG. 1, an audio signal is transmitted via two circuit paths from the second audio source interface 40 to the two differential amplifiers 51 of the amplifier circuit 50 to be processed, and then the audio signal is transmitted to the first speaker 11 and the second speaker 21 respectively; so that the amplified sound can be listened clearly by people closed to the headphone.

At last, it is necessary to mention that, the abovementioned second audio source interface 40 is disposed on the first playback unit 10; that means both the first audio source interface 30 and the second audio source interface 40 are disposed on different locations of the first playback unit 10; one of them is disposed on a bottom location and the other one is disposed on a location hidden behind the fork portion 61. However, the abovementioned second audio source interface 40 can also be disposed on the second playback unit 20, such as on a location hidden behind the fork portion 61.

In conclusion, a headphone with speaker function of the present invention provides the two audio source interfaces for an external audio interface to be inserted into, so that an audio signal can be output directly from the two speakers, or can be processed by the amplifier circuit first before being output from the two speakers. Thus, the headphone can be operated under the headphone mode or the speaker mode selected by users. Voice or music can be enjoyed by oneself under the headphone mode, or can be shared with others under the speaker mode.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A headphone with speaker function, comprising:

a first playback unit having a first speaker for playing sound;

a second playback unit having a second speaker for playing sound;

a first audio source interface disposed on the first playback unit, and is electrically connected to the first speaker and the second speaker; and a second audio source interface disposed on the first playback unit or the second playback unit, and is electrically connected to the first speaker and the second speaker via an amplifier circuit;

wherein when an audio signal is transmitted from an external audio interface via the first audio source interface, the headphone is operated under a headphone mode, and the audio signal is playback via the first speaker and the second speaker, when an audio signal is transmitted from the external audio interface via the second audio source interface, the headphone is operated under a speaker mode, and the audio signal is playback via the first speaker and the second speaker after the audio signal is amplified by the amplifier circuit;

wherein the first playback unit and the second playback unit are connected to each other by a head band, a fork portion is disposed at each end of the head band for clamping the first playback unit and the second playback unit respectively, when the headphone is operated under the headphone mode, sound output surfaces of the first playback unit and the second playback unit are faced to an inner circumference of the head band, when the headphone is operated under the headphone mode, the second audio source interface is blocked behind by the fork portion.

2. The headphone with speaker function as claimed in claim 1, wherein when the headphone is operated under the speaker mode, the first playback unit and the second playback unit are swung in corresponding to the fork portion so that the sound output surfaces are faced outward, and the second audio source interface is exposed to be inserted by the external audio interface.

3. The headphone with speaker function as claimed in claim 1, wherein the amplifier circuit includes two differential amplifiers which are electrically connected to the first speaker and the second speaker respectively.

4. The headphone with speaker function as claimed in claim 1, wherein the first audio source interface is a three poles socket or a four poles socket.

5. The headphone with speaker function as claimed in claim 4, wherein the external audio interface is a three poles plug or a four poles plug, so that the audio signal can be transmitted to the first audio source interface or the second audio source interface.

6. The headphone with speaker function as claimed in claim 1, wherein the second audio source interface is a three poles socket or a four poles socket.

7. The headphone with speaker function as claimed in claim 6, wherein the external audio interface is a three poles plug or a four poles plug, so that the audio signal can be transmitted to the first audio source interface or the second audio source interface.

* * * * *